US006727744B2

(12) United States Patent
Nagaya

(10) Patent No.: US 6,727,744 B2
(45) Date of Patent: Apr. 27, 2004

(54) REFERENCE VOLTAGE GENERATOR

(75) Inventor: Masafumi Nagaya, Miyazaki (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 10/368,473

(22) Filed: Feb. 20, 2003

(65) Prior Publication Data

US 2004/0008080 A1 Jan. 15, 2004

(30) Foreign Application Priority Data

Jul. 15, 2002 (JP) ..... 2002-205035

(51) Int. Cl.[7] ..... G05F 1/10
(52) U.S. Cl. ..... 327/540; 327/513
(58) Field of Search ..... 327/512, 513, 327/530, 534, 535, 537, 538, 539, 540, 541

(56) References Cited

U.S. PATENT DOCUMENTS 6,437,614 B1 * 8/2002 Chen ..... 327/143
6,529,066 B1 * 3/2003 Guenot et al. ..... 327/539
6,605,988 B1 * 8/2003 Gauthier et al. ..... 327/541

* cited by examiner

*Primary Examiner*—Jeffrey Zweizig
(74) *Attorney, Agent, or Firm*—Rabin & Berdo, P.C.

(57) ABSTRACT

A reference voltage generator includes an output node, a current supply circuit including a first resistor, a second resistor, and a transistor. The current supply circuit is connected to the output node. The first resistor has a first temperature coefficient. The current supply circuit supplied a current corresponding to a value of resistance of the first resistor to the output node. The second resistor is connected to the output node. The second resistor has a second temperature coefficient that is larger than the first temperature coefficient. The transistor is connected to the second resistor. The transistor is supplied with the current from the output node through the second resistor.

15 Claims, 2 Drawing Sheets

REFERENCE VOLTAGE GENERATOR

BACKGROUND OF THE INVENTION

1. Field of the Invention

This invention relates to a reference voltage generator for generating a reference voltage using a bandgap voltage.

2. Description of the Related Art

The reference voltage generator has a current supply unit comprising first through third P channel MOS (hereinafter abbreviated as "PMOS") transistors, first and second N channel MOS (hereinafter abbreviated as "NMOS") transistors, and a first resistor.

The sources of the first and second PMOS transistors are connected to a source potential VDD, and the gates thereof are connected in common. The drain of the first PMOS transistor is connected to the drain and gate of the first NMOS transistor. The source of the first NMOS transistor is connected to a ground potential GND. The drain of the second PMOS transistor is connected to the gates of the first and second PMOS transistors and the drain of the second NMOS transistor. The source of the second NMOS transistor is connected to the ground potential GND through a resistor.

The source and gate of the third PMOS transistor, which constitutes a current mirror with respect to the second PMOS transistor, are respectively connected to the source potential VDD and the gates of the first and second PMOS transistors. The drain of the third PMOS transistor is connected to the collector of a PNP transistor through a second resistor. The base and emitter of the PNP transistor are respectively connected to the ground potential GND. A reference voltage VREFO is outputted from a point A where the drain of the third PMOS transistor and the second resistor are connected.

In the present reference voltage generator, a current Ia that flows through the second PMOS transistor, is expressed as given by the following equation (1) assuming that the mutual conductances of the first PMOS transistor, the first NMOS transistor, the second PMOS transistor and the second NMOS transistor are respectively given as gm1, gm2, gm3 and gm4:

$$Ia = [(kT/q)\ln\{(gm1 \times gm4)/(gm3 \times gm2)\}]/R5 \quad (1)$$

$$= KT/R5$$

where K=(k/q) ln{(gm1×gm4)/(gm3×gm2)}

Incidentally, T indicates an absolute temperature, k and q indicate positive constants, and R5 indicates the resistance value of the first resistor, respectively.

A current Ib that flows through the third PMOS transistor constituting the current mirror with respect to the second PMOS transistor, is expressed as given by the following equation (2) assuming that the mutual conductance of the third PMOS transistor is given as gm6:

$$Ib = Ia \times (gm6/gm3) \quad (2)$$

Thus, the reference voltage VREFO outputted to the connecting point A is expressed as given by the following equation (3) assuming that the resistance value of the second resistor is given as R7 and a base-to-emitter voltage of the PNP transistor is given as VBE:

$$VREF0 = Ib \times R7 + VBE \quad (3)$$

Substituting the equations (1) and (2) for the first term of the equation (3) yields the following equation (4):

$$VREF0 = KT(gm6/gm3)(R7/R5) + VBE \quad (4)$$

Since the first and second resistors are formed in the same process, they have the same temperature characteristics. Therefore, (R7/R5) in the first term of the equation (4) does not depend on the temperature. The first term thereof has a positive temperature coefficient proportional to the absolute temperature T. On the other hand, the base-to-emitter voltage VBE of the second term has a negative temperature coefficient. Thus, the reference voltage generator is capable of generating the reference voltage VREFO with no change in temperature according to suitable adjustments to the resistance vales R5 and R7 and the mutual conductances gm1 through gm4.

The base-to-emitter voltage VBE of the PNP transistor normally has a negative temperature characteristic of about −2 mV/° C. Thus, the (Ib×R7) has to assume a positive temperature characteristic of +2 mV/° C. in order to avoid a temperature change in the reference voltage VREF0. Namely, there is a need to meet ΔIb×R7=2 mV assuming that the amount of a change in current Ib per 1° C. is given as ΔIb.

Therefore, ΔIa results in about 0.2 nA assuming that, for example, R5=1 MΩ, (gm1×gm3)/(gm3×gm2 )=10, and Ia=Ib. Accordingly, the resistance value R7 of the second resistor results in 2 mV/0.2 nA=10MΩ. A very large resistance (i.e., large circuit area) is thus required.

On the other hand, there are three methods of ① reducing the resistance value R5, ② increasing (gm1×gm3)/(gm3×gm2) and ③ increasing the current mirror of Ib/Ia with a view to reducing the resistance value R7. Since, however, any of them is a method of increasing a current to thereby increase the amount of a change in current per 1° C., current consumption increases.

Thus, a trade-off between the current consumption and the circuit area is required to generate the reference voltage VREF0 free of the change in temperature. It is therefore difficult to configure such a reference voltage generator as to simultaneously meet low current consumption and a small circuit area.

SUMMARY OF THE INVENTION

The present invention aims to provide a reference voltage generator reduced in current consumption and small in circuit area.

With a view toward solving the foregoing problem, a first invention of the present inventions provides a reference voltage generator comprising a current supply unit for supplying a current corresponding to the value of a first resistor to an output node, and a transistor supplied with the current from the output node through a second resistor, wherein the sum of a voltage developed across the second resistor and a voltage developed in the transistor is outputted from the output node as a reference voltage, and the second resistor has a temperature coefficient larger than the first resistor.

BRIEF DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

DETAILED DESCRIPTION OF THE PREFERRED EMBODIMENTS

Preferred embodiments of the present invention will hereinafter be described in detail with reference to the accompanying drawings.

Figure 1:
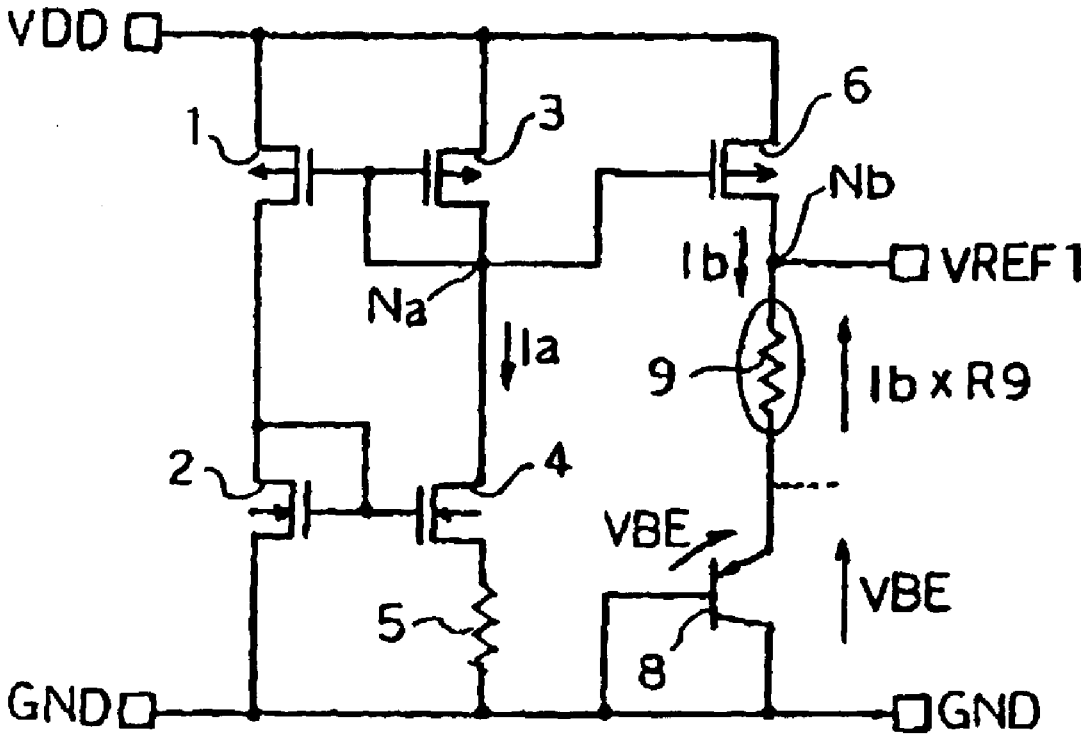
FIG. 1 is a configuration diagram of a reference voltage generator showing a first embodiment of the present invention.

FIG. 1 is a diagram showing a configuration of a reference voltage generator illustrative of a first embodiment of the present invention.

The reference voltage generator has a current supply unit comprising PMOS transistors 1, 3 and 6, NMOS transistors 2 and 4, and a resistor 5. Namely, the sources of the PMOS transistors 1 and 3 are respectively connected to a source potential VDD, and the gates of these PMOS transistors 1 and 3 are respectively connected to a node Na. The drain of the PMOS transistor 1 is connected to the drain and gate of the NMOS transistor 2. The source of the NMOS transistor 2 is connected to a ground potential GND which serves as a common potential.

Further, the drain of the PMOS transistor 3 is connected to the node Na, and the drain of the NMOS transistor 4 is connected to the node Na. The source of the NMOS transistor 4 is connected to the ground potential GND via the resistor 5. The source and gate of the PMOS transistor 6, which configures a current mirror with respect to the PMOS transistor 3, are respectively connected to the source potential VDD and the node Na, whereas the drain thereof is connected to a node Nb. The node Nb is connected to a node Nc through a resistor 9.

The resistor R9 is formed so as to have a temperature coefficient larger than that of the resistor R5. The resistors R5 and R9 are both made up of diffusion resistances each formed by doping a silicon substrate with an impurity such as boron, phosphor or the like. Changing impurity densities of these resistors 5 and 9 sets the temperature coefficients. Namely, the impurity density of the resistor 9 is set lower than that of the resistor 5 through the use of the property that the diffusion resistance decreases in temperature coefficient as it increases in impurity density, whereby the temperature coefficient of the resistor 9 is set so as to become large.

The collector of a PNP transistor 8 is connected to the node Nc, and the base and emitter thereof are respectively connected to the ground potential GND. A reference voltage VREF1 is outputted from the node Nb.

The operation of the reference voltage generator will next be described.

In the present reference voltage generator, a current Ia that flows through the PMOS transistor 3, is expressed as given by the equation (1) with the mutual conductances of the PMOS, NMOS, PMOS and NMOS transistors 1, 2, 3 and 4 being given as gm1, gm2, gm3 and gm4 respectively. Further, a current Ib that flows through the PMOS transistor 6 constituting the current mirror with respect to the PMOS transistor 3, is expressed as given by the equation (2) with the mutual conductance of the PMOS transistor 6 as gm6.

Thus, a reference voltage VREF1 outputted to the node Nb is expressed as given by the following equation (5) assuming that the resistance value of the resistor 9 is R9 and a base-to-emitter voltage of the PNP transistor 8 is VBE:

$$VREF1 = Ib \times R9 + \mathrm{VBE} \tag{5}$$

Substituting the equations (1) and (2) for the first term of the equation (5) yields the following equation (6):

$$VREF1 = KT(gm6/gm3)(R9/R5) + VBE \tag{6}$$

In the equation (6), VBE indicative of the second term thereof has a negative temperature characteristic of about −2 mV/° C. On the other hand, (R9/R5) in the first term assumes a positive temperature coefficient since the resistor 9 is formed so as to have the temperature coefficient larger than that of the resistor 5. Therefore, a temperature coefficient of the first term in the equation (6) results in a value larger than that of the first term in the conventional equation (4).

This means that even the resistance value R9 or current Ib small as compared with the conventional circuit enables generation of the reference voltage VREF1 with no change in temperature.

As described above, the reference voltage generator according to the first embodiment brings about the advantages that since it has the resistor 9 larger in temperature coefficient than the resistor 5, current consumption can be cut down and a circuit area can be reduced.

Figure 2:
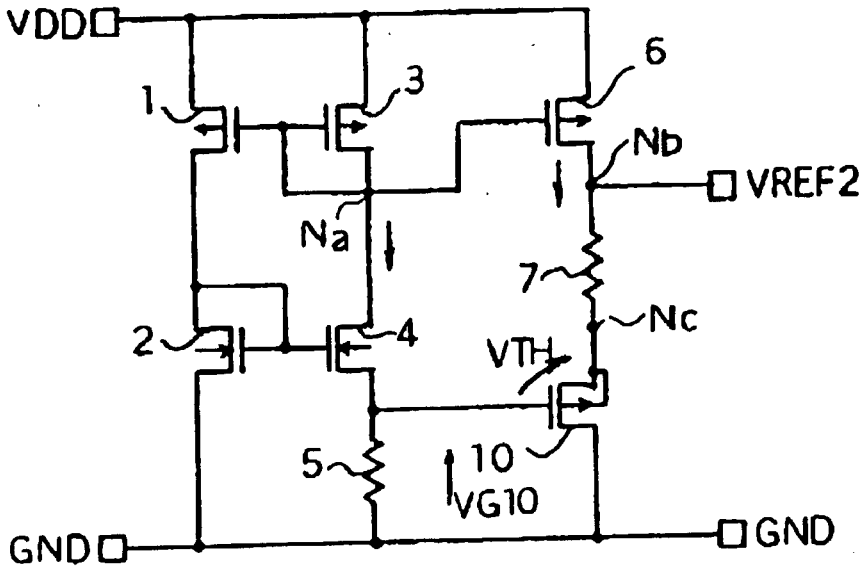
FIG. 2 is a configuration diagram of a reference voltage generator illustrating a second embodiment of the present invention.

FIG. 2 is a configuration diagram of a reference voltage generator showing a second embodiment of the present invention. Elements of structure common to those in FIG. 1 are respectively identified by common reference numerals.

The present reference voltage generator is one wherein a PMOS transistor 10 is provided as an alternative to the PNP transistor 8 shown in FIG. 1. The reference voltage generator has a current supply unit which comprises PMOS transistors 1, 3 and 6, NMOS transistors 2 and 4, and a resistor 5. Further, the source and gate of the PMOS transistor 6, which constitutes a current mirror with respect to the PMOS transistor 3, are respectively connected to a source potential VDD and a node Na, whereas the drain thereof is connected to a node Nb. The node Nb is connected to a node Nc through a resistor 7.

The source of the PMOS transistor 10 is connected to the node Nc. The drain of the PMOS transistor 10 is connected to a ground potential GND, and the gate thereof is connected to the source of the NMOS transistor 4. Incidentally, a substrate potential of the PMOS transistor 10 is connected to the source thereof, and a back gate potential thereof is set so as to become equal to a source potential. The reference voltage generator is similar in other configuration to that shown in FIG. 2 and configured such that a reference voltage VREF2 is outputted from the node Nb.

The operation of the reference voltage generator will next be explained.

In the present reference voltage generator, the reference voltage VREF2 is approximately expressed as given by the following equation (7) assuming that the gate potential and threshold voltage of the PMOS transistor 10 are VG10 and VTH respectively:

$$VREF2 = Ib \times R7 + VTH + VG10 \tag{7}$$

Since VG10=Ia×R5 here, the following equation (8) is obtained by substituting the equations (1) and (2) in the above equation:

$$\begin{aligned} VREF2 &= KT(gm6/gm3)(R7/R5) + VHT + KT \\ &= KT\{(gm6/gm3)(R7/R5) + 1\} + VTH \end{aligned} \tag{8}$$

The threshold voltage VTH of the PMOS transistor in the equation (8) has a negative temperature coefficient of about −2 mV/° C. in a manner similar to the base-to-emitter voltage VBE of the PNP transistor. On the other hand, the first term of the equation has a positive temperature coefficient proportional to the absolute temperature T. A proportionality factor of the first term is increased by K as compared with the proportionality factor in the equation (4) employed in the conventional circuit.

This means that even the resistance value R7 or current Ib small as compared with the conventional circuit allows generation of the reference voltage VREF2 free of a change in temperature.

As described above, the reference voltage generator according to the second embodiment brings about the advantages that since it has the PMOS transistor 10 having the base to which the voltage of Ia×R5 is applied, current consumption can be cut down and a circuit area can be reduced.

Figure 3:
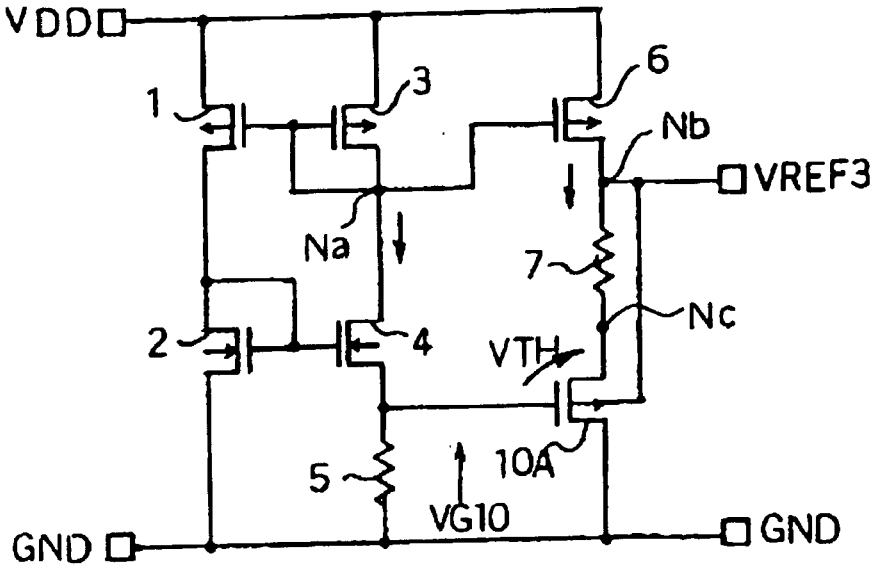
FIG. 3 is a configuration diagram of a reference voltage generator depicting a third embodiment of the present invention.

FIG. 3 is a configuration diagram of a reference voltage generator showing a third embodiment of the present invention. Elements of structure common to those in FIG. 2 are respectively identified by common reference numerals.

The present reference voltage generator has a PMOS transistor 10A as an alternative to the PMOS transistor 10 in FIG. 2. The PMOS transistor 10A is one wherein a substrate potential is connected to a node Nb such that its back gate potential becomes equal to a reference voltage VREF3. The reference voltage generator is similar in other configuration to that shown in FIG. 2 and serves so as to output the reference voltage VREF3 from the node Nb.

In the reference voltage generator, a threshold voltage VTH of the PMOS transistor 10A has a negative temperature coefficient of about −2 mV/° C. The absolute value thereof is larger than a positive temperature coefficient (i.e., K) of a gate potential VG10. Therefore, the potential applied to the source of the PMOS transistor 10A is lowered according to a rise in temperature.

Since the back gate voltage of the PMOS transistor 10 shown in FIG. 2 is identical to the source voltage, the potential at the source of the PMOS transistor 10 is reduced substantially in proportion to the temperature coefficient of the threshold voltage VTH. On the other hand, the back gate voltage of the PMOS transistor 10A shown in FIG. 3 is connected to the reference voltage VREF3. Therefore, a substrate effect is produced in the PMOS transistor 10A so that the absolute value of the threshold voltage VTH increases with the reduction in source voltage. Accordingly, the negative temperature coefficient of the source voltage at the PMOS transistor 10A is canceled by use of the change in the threshold voltage VTH due to the substrate effect and reduced as compared with the negative temperature coefficient of the PMOS transistor 10 shown in FIG. 3.

This means that even the resistance value R7 or current Ib further reduced as compared with the reference voltage generator shown in FIG. 3 allows generation of the reference voltage VREF3 free of a change in temperature.

As described above, the reference voltage generator according to the third embodiment brings about the advantages that since it has the PMOS transistor 10A, which has the base to which the voltage of Ia×R5 is applied and whose back gate voltage is connected to the reference voltage VREF3, current consumption can be cut down and a circuit area can be reduced.

Incidentally, the present invention is not limited to the illustrated embodiments, and various changes can be made thereto. As their modifications, may be mentioned ones shown below.

(a) Although the PMOS transistors 1, 3 and 6, the NMOS transistors 2 and 4, and the resistor 5 constitute the current supply unit, the configuration of the current supply unit is not limited to it.

(b) Although the PNP transistor 8 is used in FIG. 1, an NPN transistor may be used. However, when the NPN transistor is used, it is necessary to change its connecting position according to the difference in polarity.

(c) Although the PMOS transistors 10 and 10A are used in FIGS. 3 and 4 respectively, NMOS transistors may be used. However, when the NMOS transistors are used, there is a need to change their correcting positions according to the difference in polarity.

(d) The method of forming the resistors 5 and 9 shown in FIG. 1 is not limited to the illustrated method. The resistor 9 may have a temperature coefficient larger than the resistor 5.

What is claimed is:

1. A reference voltage generator, comprising:

an output node;

a current supply circuit connected to the output node, the current supply circuit including a first resistor having a first temperature coefficient, the current supply circuit supplying a current corresponding to a value of resistance of the first resistor to the output node;

a second resistor connected to the output node, the second resistor having a second temperature coefficient that is larger than the first temperature coefficient; and a transistor connected to the second resistor, the transistor supplied with the current from the output node through the second resistor.

2. A reference voltage generator according to claim 1, wherein the sum of a voltage developed across the second resistor and a voltage developed in the transistor is outputted from the output node as a reference voltage.

3. A reference voltage generator according to claim 1, wherein the first and second resistors are formed on a silicon substrate by implanting ions.

4. A reference voltage generator according to claim 3, wherein a density of the implanted ions of the second resistor is lower than that of the first resistor.

5. A reference voltage generator according to claim 1, wherein the transistor is a bipolar transistor.

6. A reference voltage generator according to claim 1, wherein the current supply circuit includes:

a first current mirror circuit connected to a first power supply source;

a second current mirror circuit connected to a second power supply source and the first current mirror circuit;

the first resistor connected between the second power supply source and the second current mirror circuit;

a reference node located between the first and second current mirror circuits; and a MOS transistor having a first terminal connected to the first power supply source, a second terminal connected to the output node and a control terminal connected to the reference node.

7. A reference voltage generator, comprising:

an output node;

a current supply circuit connected to the output node, the current supply circuit including a first resistor having a first temperature coefficient, the current supply circuit supplying a current corresponding to a value of resistance of the first resistor to the output node;

a second resistor connected to the output node, the second resistor having a second temperature coefficient that is larger than the first temperature coefficient; and a MOS transistor having a first terminal connected to the second resistor, the MOS transistor supplied with the current from the output node through the second resistor.

8. A reference voltage generator according to claim 7, wherein the sum of a voltage developed across the second resistor and a voltage developed in the transistor is outputted from the output node as a reference voltage.

9. A reference voltage generator according to claim 7, wherein the first and second resistors are formed on a silicon substrate by implanting ions.

10. A reference voltage generator according to claim 9, wherein a density of the implanted ions of the second resistor is lower than that of the first resistor.

11. A reference voltage generator according to claim 7, wherein the MOS transistor is a PMOS transistor.

12. A reference voltage generator according to claim 11, wherein the PMOS transistor has a back gate connected to the first terminal thereof.

13. A reference voltage generator according to claim 11, wherein the PMOS transistor has a back gate connected to the output node.

14. A reference voltage generator according to claim 7, wherein the current supply circuit includes:

a first current mirror circuit connected to a first power supply source;

a second current mirror circuit connected to a second power supply source and the first current mirror circuit;

the first resistor connected between the second power supply source and the second current mirror circuit;

a reference node located between the first and second current mirror circuits; and a MOS transistor having a first terminal connected to the first power supply source, a second terminal connected to the output node and a control terminal connected to the reference node.

15. A reference voltage generator according to claim 7, wherein the MOS transistor has a control terminal connected to a node located between the second current mirror circuit and the first transistor, and a second terminal connected to the second power supply source.

* * * * *